United States Patent [19]

Logan, Jr.

[11] 4,324,300

[45] Apr. 13, 1982

[54] ROTARY DRILL BIT

[76] Inventor: Clifford K. Logan, Jr., P.O. Box 3446, Hickory, N.C. 28601

[21] Appl. No.: 164,337

[22] Filed: Jun. 30, 1980

[51] Int. Cl.[3] ..... E21B 10/26; E21B 10/62; E21B 10/04

[52] U.S. Cl. ..... 175/379; 175/387; 175/391; 175/404

[58] Field of Search ..... 175/379, 387, 390, 391, 175/20, 403, 404, 405

[56] References Cited

U.S. PATENT DOCUMENTS

| | | | |
|---|---|---|---|
| 1,163,867 | 12/1915 | Shaffer | 175/379 |
| 1,505,460 | 8/1924 | Griesche | 175/379 |
| 1,572,386 | 2/1926 | Gates | 175/379 |
| 2,203,747 | 6/1940 | Sandstone | 175/379 |
| 2,262,001 | 11/1941 | Hokanson | 175/390 |
| 2,342,931 | 2/1944 | Fortune | 175/379 |
| 2,599,770 | 6/1952 | Marcerou | 175/403 X |
| 2,819,043 | 1/1958 | Henderson | 175/379 X |
| 2,830,795 | 4/1958 | Center | 175/394 X |
| 2,833,520 | 5/1958 | Owen | 175/379 |
| 2,966,949 | 1/1961 | Wepsala | 175/379 |
| 3,202,035 | 8/1965 | Rosselet | 175/405 X |
| 3,295,617 | 1/1967 | Willis | 175/379 |
| 3,495,359 | 2/1970 | Smith et al. | 175/379 |
| 3,696,873 | 10/1972 | Anderson | 175/20 |

FOREIGN PATENT DOCUMENTS

| | | | |
|---|---|---|---|
| 851331 | 10/1952 | Fed. Rep. of Germany | 175/387 |
| 263459 | 11/1970 | U.S.S.R. | 175/387 |
| 636385 | 12/1978 | U.S.S.R. | 175/379 |

*Primary Examiner*—Ernest R. Purser
*Attorney, Agent, or Firm*—C. Clark Dougherty, Jr.

[57] ABSTRACT

A drill bit including a support member and a plurality of concentrically positioned, hollow, cylindrical cutting members connected to the support member is disclosed. Each of the cutting members includes a beveled edge obliquely extending between the inner and outer surfaces thereof. The beveled edges are aligned so that a tapered cutting surface is defined.

7 Claims, 9 Drawing Figures

ROTARY DRILL BIT

BACKGROUND OF THE INVENTION

1. Field of the Invention

This invention relates generally to drill bits and more particularly, but not by way of limitation, to rotary drill bits having tapered cutting surfaces.

2. Description of the Prior Art

In drilling operations, such as those which occur in constructing an oil and/or gas well, the types of drill bits used frequently have relatively horizontally disposed cutting surfaces whereby the cutting of the workpiece occurs over a surface area approximately equal to only the cross-sectional area of the drill bit. To increase the surface area which is contacted by the cutting surface of the drill bit, it is necessary to provide a tapered cutting surface on the drill bit. To further enhance the cutting ability of the drill bit, it is desirable to provide a plurality of sharp edges along the tapered cutting surface. So that the taper can be retained on the drill bit as the drill bit wears during use, it is further desirable to provide the drill bit with a construction which maintains its tapered cutting surface even as it wears. Additionally, it is desirable to make such a drill bit structurally strong by having the cutting members include solid wall structures along the entire longitudinal cutting length of the drill bit.

U.S. Pat. No. 2,203,747 in the name of Sandstone discloses a laminated disk drill bit which, in the embodiment shown in FIG. 2 of the Sandstone patent, has a conically shaped cutting face. However, the cutting members are comprised of a plurality of longitudinally stacked cutting disks which are connected by suitable fastener means. Therefore, the Sandstone device fails to include cutting members which comprise single structures extending along the entire cutting length of the drill bit.

SUMMARY OF THE INVENTION

The present invention overcomes the above-noted and other shortcomings of the prior art by providing a novel and improved rotary drill bit. This drill bit includes a tapered cutting surface which increases the cutting surface area over the cutting surfaces of those drill bits having substantially horizontal cutting surfaces. The present invention includes cutting members which maintain the tapered cutting surface as the bit wears and which are each single structural units extending along the entire longitudinal cutting length of the drill bit. These cutting members also have multiple sharp edges disposed along the tapered surface area for engaging the workpiece to be drilled.

Broadly, the drill bit constructed in accordance with the present invention includes a support member having a coupling end for attachment to a drill bit drive means, and a plurality of concentrically positioned cylindrical cutting members. Each of the cutting members includes a first end which is connected to the end of the support member opposite the coupling end thereof. Each cutting member also includes a second end having a beveled edge obliquely extending between inner and outer surfaces of the respective cylindrical cutting member. Each of these beveled edges is aligned with each adjacent beveled edge so that the drill bit has a tapered cutting surface. Each cutting member is radially spaced from each adjacent cutting member so that a respective annular region is defined therebetween.

Therefore, from the foregoing, it is a general object of the present invention to provide a novel and improved rotary drill bit. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 6 is a cross-sectional elevational view of the FIG. 4 embodiment.

FIG. 9 is a cross-sectional elevational view of the FIG. 7 embodiment.

DETAILED DESCRIPTION OF PREFERRED EMBODIMENTS OF THE PRESENT INVENTION

Figure 1:
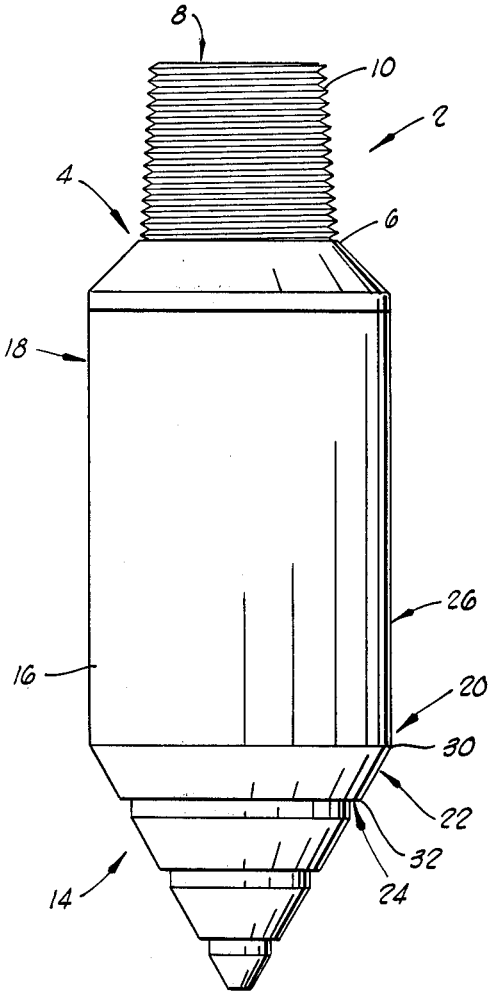
FIG. 1 is an elevational view of a first preferred embodiment of the present invention.
Figure 3:
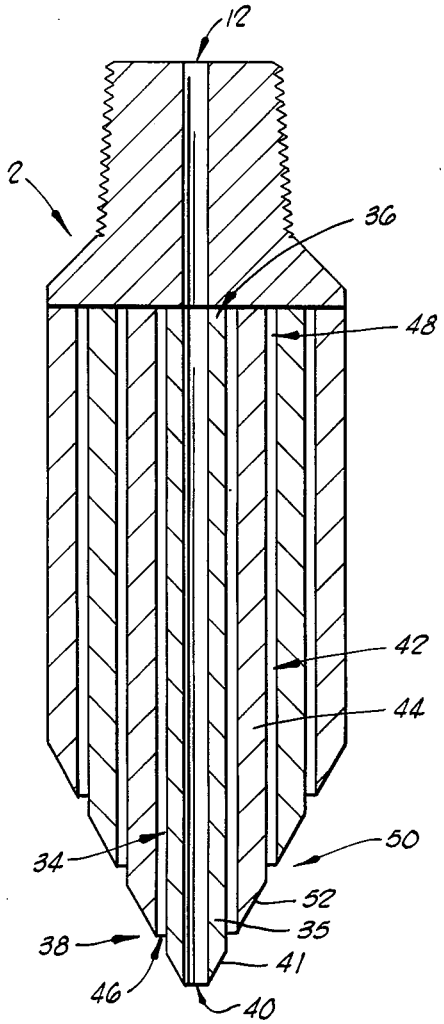
FIG. 3 is a cross-sectional elevational view of the FIG. 1 embodiment.
Figure 2:
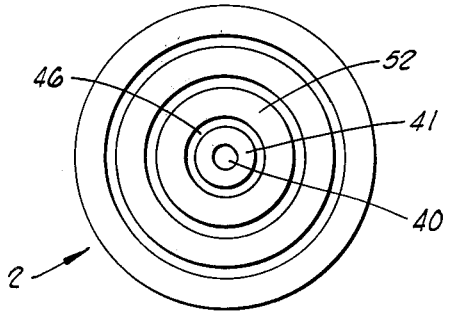
FIG. 2 is a bottom plan view of the FIG. 1 embodiment.

With reference to FIGS. 1–3 a first preferred embodiment of a drill bit 2 constructed in accordance with the present invention will be described. The drill bit 2 includes support means 4 for coupling the drill bit 2 to a drill bit drive means (not shown), such as a drill string and a rotary drilling table as are known in the oil and gas drilling industry. In the first preferred embodiment the support means 4 particularly includes a support member 6 having a coupling end 8 extending therefrom for attachment to the drill bit drive means. The coupling end 8 may include a threaded connector 10 as is shown in FIGS. 1–3, or it may include a box end or other suitable coupling means for joining the drill bit to the drill bit drive means. FIG. 3 shows that the support member 6 also has an opening 12 extending longitudinally therethrough. The opening 12 can be used to inject an appropriate drilling fluid into the well bore via the tubing string and the drill bit 2 so that loosened portions of the workpiece, such as the ground, resulting from the drilling process can be flushed from the well bore.

The drill bit 2 further includes a plurality of cutting members 14, each of which is generally shown to have a hollow cylindrical configuration and to be concentrically positioned one within the other. It is to be noted that each of the cutting members 14 includes a single structural member or wall 16 along the entire longitudinal cutting length of the drill bit 2.

Each of the cutting members 14 includes a first end 18 which is connected to the end of the support member 6 opposite the coupling end 8 thereof. This connection is made by any suitable means, such as by welding or by integrally forming the cutting members with the support member 6.

Each cutting member 14 also includes a second end 20 having a beveled edge 22 obliquely extending between an inner surface 24 and an outer surface 26 of the respective hollow cylindrical cutting member 14. As shown in the Figs. each of the beveled edges 22 is aligned with each adjacent beveled edge so that the drill bit 2 has a tapered cutting surface.

For the embodiment shown in FIGS. 1–3 each beveled edge 22 has a first perimeter 30 defined by the intersection of the respective edge 22 and the outer surface 26 of the respective cutting member 14 at a respective first distance from the first end 18 of the respective cutting member 14. Each of the edges 22 also has a second perimeter 32 defined by the intersection of the respective edge 22 and the inner surface 24 of the respective cutting member 14 at a respective second distance from the first end 18 of the respective cutting member 14 wherein the second distance is greater than the first distance. In other words, the beveled edges 22 extend along the second ends 20 of the cutting members 14 and are linearly aligned so that a downwardly converging cutting surface is defined on the drill bit.

FIG. 3 more particularly discloses that the plurality of cutting members 14 includes a first cylindrical cutting member 34 defined by a structural wall 35 having a first end 36 and a second end 38 as previously described and further including a channel 40 extending longitudinally therethrough in register with the opening 12 in the support member 6 so that fluid can pass through the drill bit 2 by means of the opening 12 and the channel 40 for flushing loosened portions of the drilled workpiece out of the drilled hole, for example. The cutting member 34 includes a tapered or beveled edge 41.

The plurality of cutting members 14 further includes a second cylindrical member 42 defined by a second structural wall 44 having a hollow portion, or channel, 46 in which the first cutting member 34 is substantially concentrically disposed. The second cutting member 42 includes a first end 48 and a second end 50 as previously described. The second end 50 has a tapered edge 52 which is linearly aligned with the tapered edge 41 of the first cutting member 34.

FIGS. 2 and 3 disclose that the cutting member 34 is radially spaced from the adjacent cutting member 42 so that a respective annular region is defined therebetween. This annular region permits the second perimeter 32 of each of the plurality of cutting members 14 to be spaced from adjacent cutting members so that the sharp edge of the cutting surface defined thereby can adequately contact the workpiece and thereby cut into it.

As shown in FIGS. 1–3, additional specific cutting members can be included in the plurality of cutting members 14.

Figure 4:
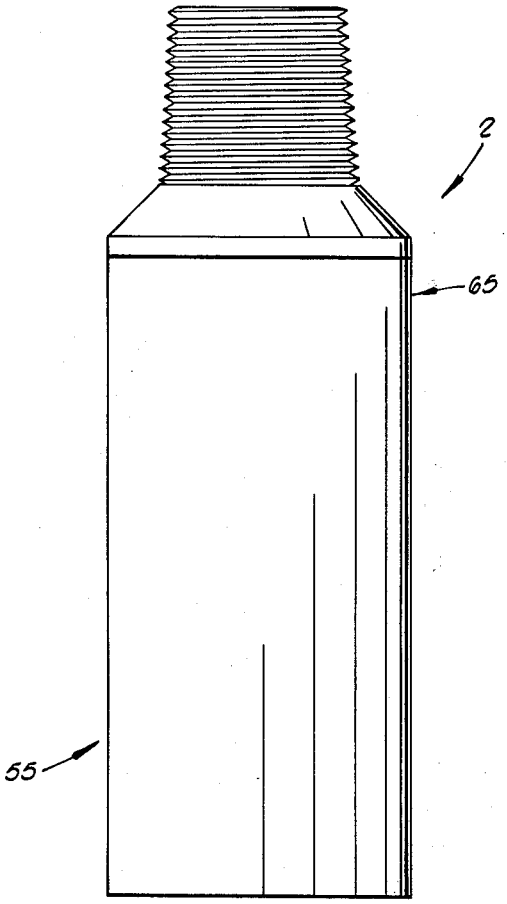
FIG. 4 is an elevational view of a second preferred embodiment of the present invention.
Figure 5:
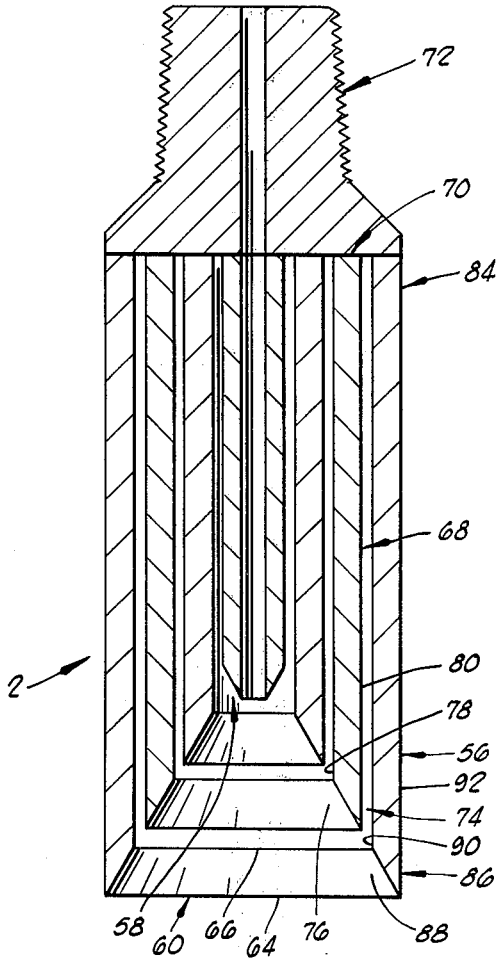
FIG. 5 is a bottom plan view of the FIG. 4 embodiment.
Figure 5:
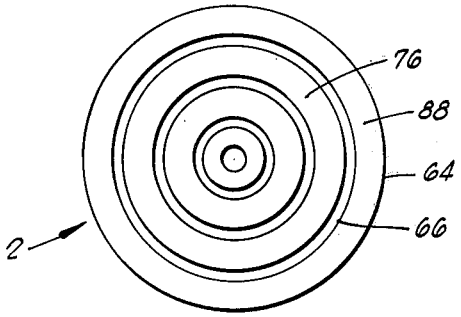

With reference to FIGS. 4–6 a second preferred embodiment of the drill bit 2 constructed in accordance with the present invention will be described. This preferred embodiment includes a plurality of cutting members 55 which are similar to the cutting members 14 except that the length of each cutting member 55 decreases from an outermost and longest cutting member 56 to an innermost and shortest cutting member 58. The cutting members include beveled edges 60 which define an outwardly diverging cutting surface. More particularly, each of the beveled edges 60 of each cutting member 55 has a first perimeter 64 defined by the intersection of the respective edge and the outer surface of each respective one of the cutting members 55 at a respective first distance from a first end 65 of the respective cutting member, and each cutting member 55 also has a second perimeter 66 defined by the intersection of the respective edge and the inner surface of the respective cutting member at a respective second distance from the first end of the respective cutting member. In the second embodiment the first distance is greater than the second distance.

More particularly, FIG. 6 indicates that the drill bit 2 includes a first hollow, cylindrical cutting member 68, for example, which has a first end 70 connected to a support member 72 which is similar to the support member 6. The cutting member 68 also has a second end 74 spaced a first distance from the first end 70. The second end 74 has a beveled edge 76 extending downward from an inner surface 78 to an outer surface 80 of the respective cutting member 68.

The drill bit 2 further includes a second hollow, cylindrical cutting member, such as the outermost cutting member 56, having a first end 84 connected to the support member 72 so that the first cutting member 68 is concentrically disposed within the second cutting member 56. The second cutting member 56 also includes a second end 86 spaced a second distance from the first end 84. The second distance is greater than the first distance separating the first and second ends 70 and 74 of the first cutting member 68. The second end 86 of the second cutting member 56 has a beveled edge 88 extending downward from an inner surface 90 to an outer surface 92 thereof and is linearly aligned with the beveled edge 76 of the first cutting member 68. The second preferred embodiment drill bit 2 includes other elements which have been previously discussed with respect to the first preferred embodiment.

Figure 7:
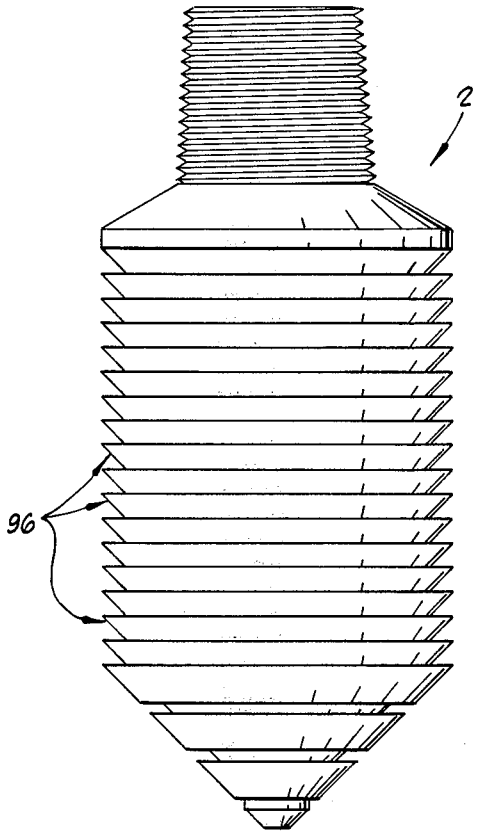
FIG. 7 is an elevational view of a third preferred embodiment of the present invention.
Figure 8:
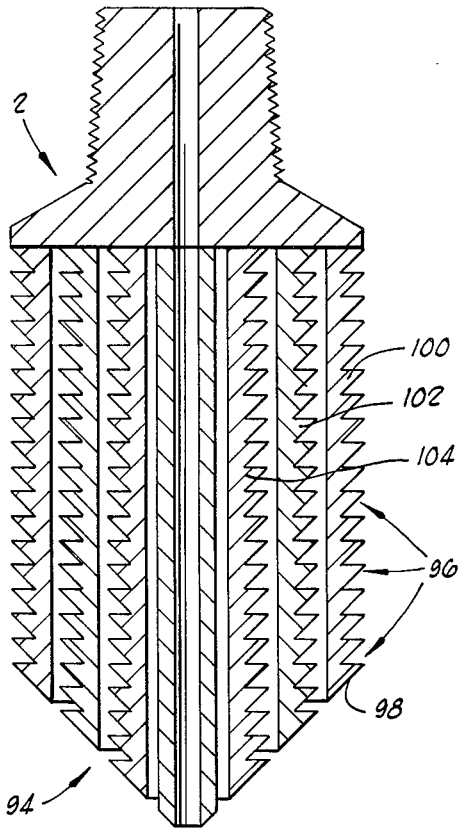
FIG. 8 is a bottom plan view of the FIG. 7 embodiment.
Figure 8:
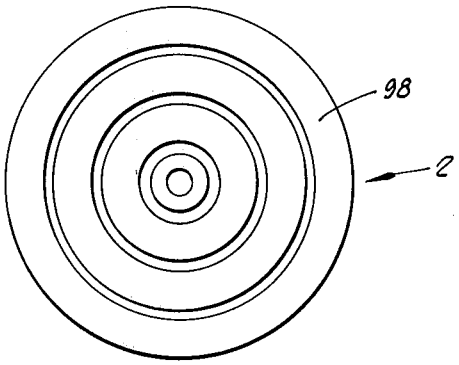

A third preferred embodiment of the present invention is depicted in FIGS. 7–9. This third preferred embodiment is constructed similarly to the first preferred embodiment shown in FIGS. 1–3; however, each of a plurality of longitudinally extending cutting members 94 of the third preferred embodiment includes a plurality of substantially annular segments 96 which have beveled edges 98 and which are disposed axially along the respective cutting member. Each of the annular segments 96 extends circumferentially around the respective cutting member. FIGS. 7 and 9 disclose that the beveled edges 98 of corresponding sets of annular segments are linearly aligned so that as each preceding corresponding set of annular segments is worn away by the cutting process, a tapered edge is maintained. An example of a corresponding set of annular segments is identified in FIG. 9 by reference numbers 100, 102 and 104.

It is to be noted that appropriate blade elements (not shown) can be placed in the longitudinally extending channel which is formed in each of the innermost cutting members illustrated in FIGS. 1–9 for drilling through any of the drilled workpiece material which might enter these channels and not otherwise be cut. Suitable blade elements (not shown) can also be placed in the annular regions between adjacent cutting members if this is found to be necessary for the particular size of drill bit made.

Thus, the present invention of an improved rotary drill bit having a tapered cutting surface formed from a plurality of cutting members, each of which is constructed of a single, longitudinally extending member, is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A rotary drill bit, comprising:

a support member having a coupling end for attachment to a drill bit drive means; and a cylindrical cutting member, including:

an inner surface;

an outer surface;

a first end connected to the end of said support member opposite the coupling end thereof;

a second end having a first beveled edge obliquely extending between said inner and outer surfaces; and a plurality of substantially annular rotary cutting segments having beveled second edges and being disposed axially along said cutting member, each of said annular segments extending circumferentially around said cutting member for providing a plurality of rotary cutting surfaces.

2. A rotary drill bit, comprising:

a support member having a coupling end for attachment to a drill bit drive means; and a plurality of concentrically positioned cylindrical cutting members, each of said cutting members including:

an inner surface;

an outer surface;

a first end connected to the end of said support member opposite the coupling end thereof;

a second end having a first beveled edge obliquely extending between said inner and outer surfaces, the first beveled edges of the plurality of cutting members being aligned so that said rotary drill bit has a tapered cutting surface; and a plurality of substantially annular rotary cutting segments having second beveled edges and being disposed axially along the respective cutting member, each of said annular segments extending circumferentially around the respective cutting member for providing a plurality of rotary cutting surfaces.

3. A rotary drill bit as defined in claim 2, wherein said second beveled edges of the plurality of cutting members are arranged in corresponding sets wherein each set includes one of said rotary cutting segments on each of said cutting members, and wherein the second beveled edges of the rotary cutting segments of a respective corresponding set are linearly aligned so that as each preceding corresponding set of rotary cutting segments is worn away by the rotary cutting process, the tapered cutting surface is maintained.

4. A drill bit as defined in claim 3, wherein each cutting member is radially spaced from each adjacent cutting member so that a respective annular region is defined therebetween.

5. A drill bit, comprising:

support means for coupling said drill bit to a drill bit drive means, said support means including a longitudinally extending opening through which fluid can flow;

a first cylindrical cutting member including:

a first end connected to said support means;

a second end having a tapered edge;

a channel extending longitudinally therethrough in register with the opening in said support means so that fluid can pass through said drill bit by means of said opening and said channel; and a plurality of first annular cutting segments having beveled edges and being disposed axially along said first cylindrical cutting member between said first and second ends thereof, each of said first annular segments extending circumferentially around said first cylindrical cutting member; and a second cylindrical cutting member including:

a hollow central portion in which said first cutting member is substantially concentrically disposed;

a first end connected to said support means;

a second end having a tapered edge linearly aligned with the tapered edge of said first cutting member; and a plurality of second annular cutting segments having beveled edges and being disposed axially along said second cylindrical cutting member between said first and second ends thereof, each of said second annular segments extending circumferentially around said second cylindrical cutting member.

6. A drill bit as defined in claim 5, wherein said beveled edges of said cutting members are arranged in corresponding sets wherein each set includes one of said cutting segments on each of said cutting members and wherein the cutting segments of a respective corresponding set are linearly aligned so that as each preceding corresponding set of cutting segments is worn away by the rotary cutting process, a tapered cutting surface is maintained.

7. A drill bit as defined in claim 6, wherein said cutting members are radially spaced from each other so that a respective annular region is defined therebetween.

* * * * *